US005490459A

United States Patent [19]

Hoff

[11] Patent Number: 5,490,459

[45] Date of Patent: Feb. 13, 1996

[54] PRINTING PRESS AND METHOD FOR REMOVING INK BUILD-UP WITH SIDEWAYS WEB MOVEMENT

[75] Inventor: Howard W. Hoff, Lee, N.H.

[73] Assignees: Heidelberger Druckmaschinen AG, Heidelberg, Germany; Heidelberg Harris, Inc., Dover, N.H.

[21] Appl. No.: 394,094

[22] Filed: Feb. 24, 1995

[51] Int. Cl.[6] ..... B41F 35/00

[52] U.S. Cl. ..... 101/423; 226/18; 15/256.51

[58] Field of Search ..... 101/423, 424, 101/425, 483; 15/256.51, 256.53; 226/18, 19

[56] References Cited

U.S. PATENT DOCUMENTS

| | | | |
|---|---|---|---|
| 3,486,448 | 12/1969 | Anderson et al. | 101/425 |
| 3,783,782 | 1/1974 | Hardt | 101/425 |
| 4,686,902 | 8/1987 | Allain et al. . | |
| 4,765,242 | 8/1988 | Oya et al. | 101/423 |
| 4,930,415 | 6/1990 | Hara et al. | 101/425 |
| 4,967,664 | 11/1990 | Iijima | 101/423 |
| 5,080,015 | 1/1992 | Hansson et al. | 101/483 |
| 5,109,770 | 5/1992 | Uribe et al. . | |
| 5,379,695 | 1/1995 | Rieth et al. | 101/424 |
| 5,423,259 | 6/1995 | Su | 101/423 |

*Primary Examiner*—Eugene H. Eickholt
*Attorney, Agent, or Firm*—Kenyon & Kenyon

[57] ABSTRACT

A web printing press and a method of reducing ink build-up on a printing cylinder of a web printing press are described. The web is moved sideways, either by web guides or by moving a web roll stand, during a printing cylinder wash operation to aid in removing ink build-up.

9 Claims, 4 Drawing Sheets

PRINTING PRESS AND METHOD FOR REMOVING INK BUILD-UP WITH SIDEWAYS WEB MOVEMENT

FIELD OF THE INVENTION

The present invention relates generally to printing presses and more specifically to a web printing press and a method for removing ink build-up on a printing cylinder of the web press.

BACKGROUND OF THE INVENTION

Cleaning systems for blanket cylinders of an offset web press are already known. In a known offset web press, a web is fed through a plurality of printing units, where images of different colors are printed onto the web. The web is then fed to a dryer, chill roll and a folder or other finishing equipment. The printing units each have an upper and lower blanket cylinder which define a nip through which the web passes. Each blanket cylinder has an associated plate cylinder having an ink feed.

A cleaning device, which includes a brush roller with bristles for selectively contacting the blanket, is associated with each blanket cylinder. Provided in the cleaning device is a cleaning fluid distribution tube for applying cleaning fluids, including organic solvents and water, to the brush roller.

During normal press operation, the brush roller is out of contact with the blanket and the cleaning device is inactive. Ink, gum, clay coatings, anti-offset powders and other substances may build up at this time on the blanket surface, which then needs to be cleaned.

When the press is to be cleaned during a cleaning or wash cycle, cleaning fluids are applied to the blanket and the brush roller contacts the blanket. The web is still running at this time, and much of the waste fluid, containing solvents, other fluids and waste particles from the blanket surface, is carried away by the web. The rest is collected by a drain tray.

Such a cleaning system is described in U.S. Pat. No. 5,109,770, which is hereby incorporated by reference.

However, when the width of the web is less than the width of the blanket, i.e. the web is not against its lateral limit on the blanket, significant amounts of ink build up between the lateral limit and the actual edge of the web during normal printing operation of the press.

The normal cleaning or wash cycle then is unable to sufficiently remove this excessive build-up of ink, leading to several problems, including smudging and friction at the edge of the web, which can lead to poor print quality and web breaks.

SUMMARY AND ADVANTAGES OF THE PRESENT INVENTION

The present invention therefore provides a method of cleaning a printing cylinder of a printing press having a web running over the printing cylinder, the web being laterally narrower than a width of the printing cylinder, the method comprising the steps of: initiating a wash cycle for cleaning of the printing cylinder of the web press; applying a cleaning liquid to the printing cylinder; and moving the web laterally during the wash cycle to assist in cleaning the printing cylinder.

This method provides the advantage that the web itself aids in clearing away the build-up of the ink at the edges of the former path of the web.

The web may be moved laterally in a variety of manners. At the initiation of a wash cycle, the web at the printing cylinders may be moved slightly from side to side by an entry web guide and an exit web guide. This movement should be slight enough and timed properly not to break the web. This timing will depend on a number of factors such as web strength, web width, the speed of the press during the wash cycle, etc. The web should move sideways to clear away enough ink to create a path which minimizes smearing and other problems related to the ink-build-up. It has been found that moving the web approximately one-half inch from the center to each side, so that the web path is approximately one inch wider than the web, is often sufficient.

The lateral movement of the web can occur every wash, alternate washes, or at some other frequency, depending on the amount of ink build-up. It can also be staggered such that the web only moves laterally in one direction for one sequence and then in the other direction for the next sequence.

When the printing press is in its final wash cycle, i.e. when a job is finished, it is often advantageous to move the web between the full lateral limits (one limit on a gear side and one limit a work side) of the printing cylinder to clean the entire cylinder. This can be accomplished by moving the entire web in the entire press from side to side. The roll stand for the web can sidelay to its limit and the angle bars and slitters in the folder will move in the same direction. The web guide sensors will open to essentially deactivate the web guides. If there are folder fans for receiving signatures from the folder, these fans can open slightly to allow any misalignment to pass through.

The movement of all of these parts is synchronized so that the press continues to run and the blanket wash occurs.

After a lateral limit is reached, either on the gear side or the work side, the web is then moved to the opposite limit to finish the cleaning process.

Upon reaching the second limit the press can automatically decelerate and stop, or else the web can be centered again before the press is stopped.

The present invention also encompasses a printing press having a running web comprising a web roll stand for holding the web in a wound state, at least one printing unit comprising a printing cylinder for printing images on the running web, an entry web guide between the web roll stand and the printing unit for guiding the web as it enters the printing unit, an exit web guide for guiding the web as it exits the printing unit, and a wash unit for cleaning the printing cylinder during a wash cycle. In this press, at least one of the entry web guide and the exit web guide are laterally moveable so as to be able to guide the web laterally during the wash cycle. This movement assists in the removal of ink build-up.

In addition, the present invention encompasses a printing press having a running web comprising a web roll stand, at least one printing unit having a printing cylinder having lateral limits for the running web, an entry web guide, an exit web guide, a wash unit, and a folder, the web roll stand being laterally moveable so as to allow the web to move against the lateral limits of the printing cylinder. This construction allows the print cylinder to be fully cleaned during a final wash cycle.

BRIEF DESCRIPTION OF THE DRAWINGS

The drawings show the invention on the basis of the preferred embodiment, in which.

DETAILED DESCRIPTION

Figure 1:
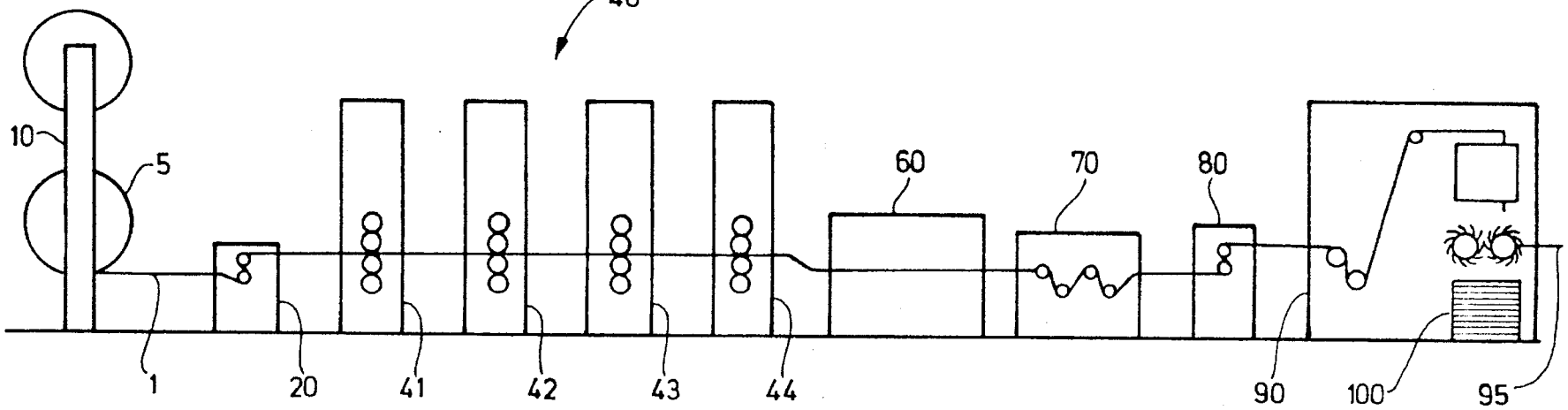
FIG. 1 is a side view of a web press.

FIG. 1 shows a side view of the printing press of the present invention. A web roll 5 is held in web roll stand 10. A web 1 from the web roll 5 passes through an entry web guide 20 before entering a printing unit section 40 of the press. The printing unit section is shown with four printing units 41, 42, 43, and 44 for color printing in a known manner. However, the printing unit section 40 may contain any number of printing units. The printed web 1 which exits the printing unit section passes through a dryer 60 and chill rolls 70. After exiting the chill rolls 70, the web 1 passes through an exit guide 80 before entering a folder 90. The folder 90 arranges and cuts the web 1 to deliver individual signatures to folder fans 95 which place the signatures in a stack 100.

Figure 2:
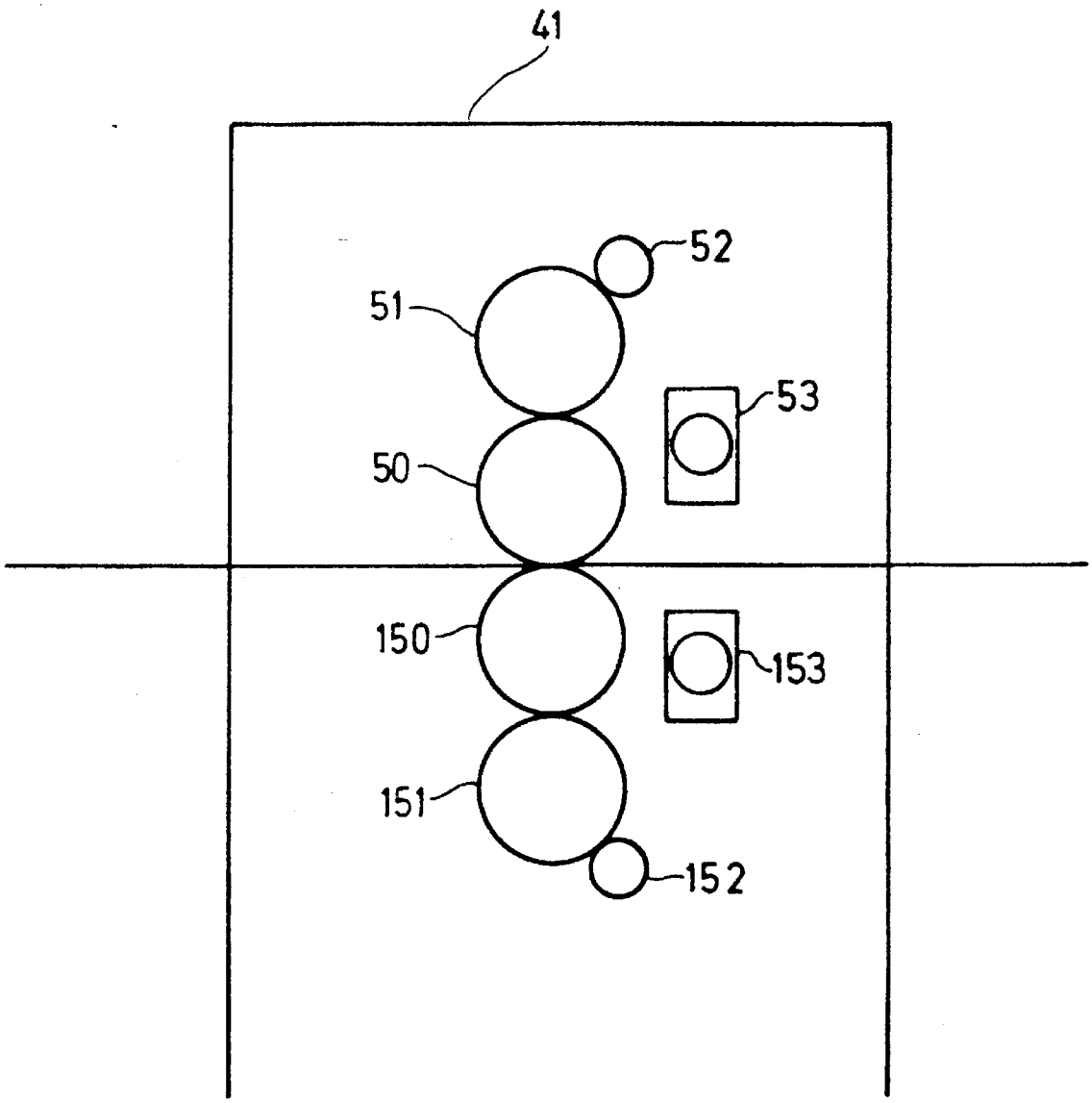
FIG. 2 is a side view of a printing unit of the press

The structure of the printing units is shown in FIG. 2. Printing unit 41 is an offset printing unit comprising an upper blanket cylinder 50, an upper plate cylinder 51, an upper ink roll 52 and an upper blanket cleaning device 53. The upper blanket cylinder 50 forms a nip through which the web 1 passes with a lower blanket cylinder 150. A lower plate cylinder 151, a lower ink roll 152 and a lower blanket cleaning device 153 are also provided.

During a printing run of the press, the upper ink roll 52 provides ink from an ink source to upper plate cylinder 51 which then transfers an image to the upper blanket cylinder 50. Blanket cylinder 50 then transfers the image to the running web 1. The same process takes place with lower ink roll 152, lower plate cylinder 151 and lower blanket cylinder 150 on the other side of the web.

Figure 3:
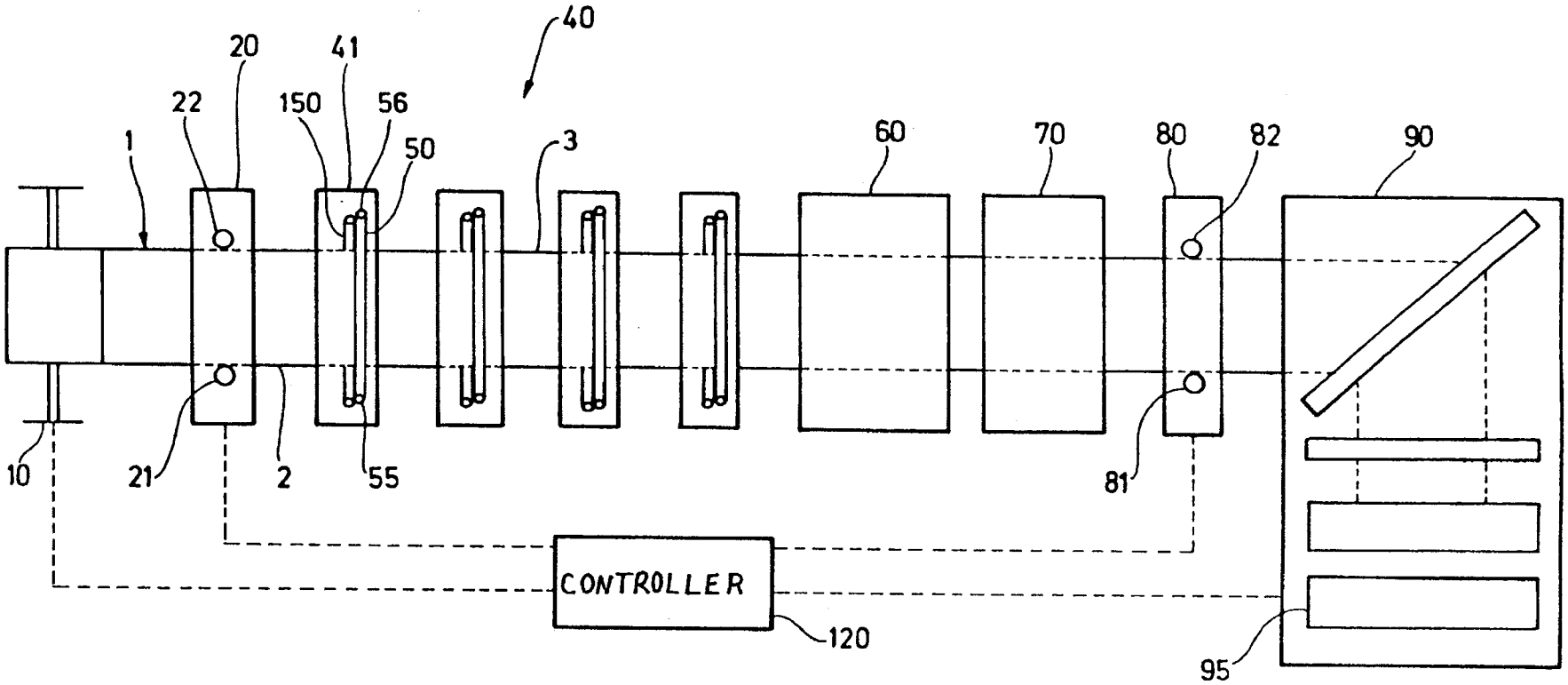
FIG. 3 is a view of a printing cylinder of the web press and the web during normal operation.

As shown in FIG. 3, the web 1 may be much narrower than the width of the blanket cylinder 50 and the plate cylinder 51. Therefore, excessive ink from the ink roller 52 may build up between a lateral limit 55 of the blanket cylinder 50 and an edge 2 of the web 1, as well as between a lateral limit 56 of the blanket cylinder 50 and an edge 3 of the web 1. In these areas, the two blanket cylinders 50, 150 do not necessarily contact each other because of the thickness of the web 1, and this gap may be filled with ink, dirt, gum particles or other substances to create an undesired build-up.

As also shown in FIG. 3, the entry web guide 20 has two guide sensors 21 and 22. These guide sensors 21, 22 can sense the respective edges 2, 3 of the web and set the path for the web 1. The entry web guide 20 then places the web 1 between the sensors 21, 22. Therefore, by moving the sensors 21, 22 of the entry web guide 20, the path of the web 1 through the entry web guide can be controlled.

The exit web guide 80 operates in the same manner with two guide sensors 81, 82.

A controller 120 with a microprocessor is electrically connected to the sensors 21, 22, 81, 82 and can control the movement of the web between the entry web guide 20 and the entry web guide 80 by positioning the sensors. The controller 120 can receive various inputs, including web speed, web width, web thickness, paper strength, timing and number of wash cycles, etc.

According to the present invention, during a wash cycle when the press is not printing the controller 120 operates to move the entry web guide sensors 21, 22 sideways in one direction by a small amount and the exit web guide sensors 81, 82 sideways in the same direction by a small amount, thereby moving the web laterally. The entry web guide sensors 21, 22 and exit web guide sensors 81, 82 can either move simultaneously, or be timed to move one after the other.

By moving the web sideways during the wash cycle, the moving web 1 operates to help remove ink and other material build-up between the former web edge and the the current web edge.

The web can then be moved sideways in the other direction to extend laterally beyond the former web edge on the other side of the web to remove ink build-up between that former web edge and the current web edge. This second movement can occur either during the same wash cycle, during a successive wash cycle, or timed in any other manner set by the controller 120.

As shown in FIG. 3, in addition to being connected to entry web guide 20 and exit web guide 80, the controller 120 is connected electrically as well to the web roll stand 10 and the folder 90, including folder fans 95.

During a final wash cycle, i.e. the last wash cycle before the press is to be shut down, the press can operate to clean the entire width of the blanket cylinders in the following manner.

Figure 4:
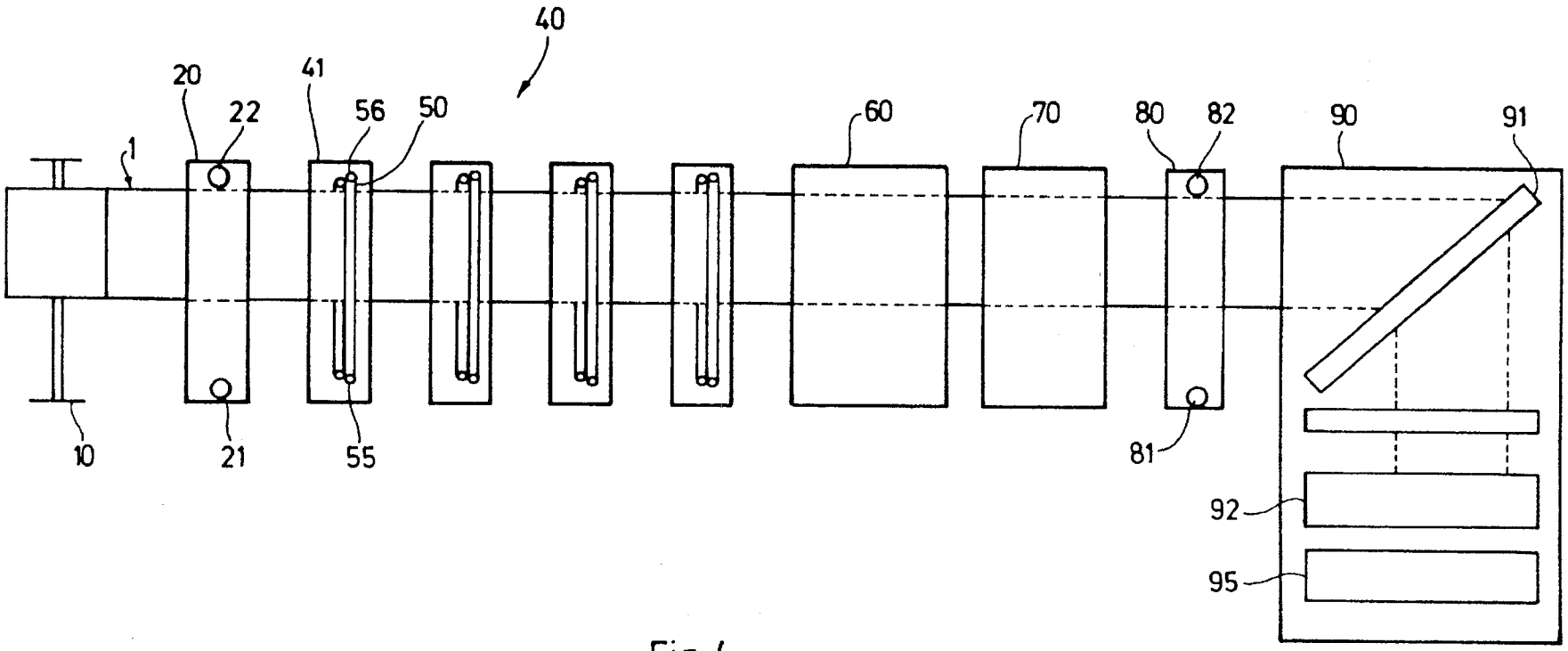
FIG. 4 is a view of a printing cylinder of the web press and the web at one of its limits.

The controller 120 sends a signal which moves the web roll stand 10 to a lateral limit corresponding to the lateral limit 56 of the blanket cylinder, as shown in FIG. 4.

At approximately the same time the web roll stand 10 is moved, the controller moves the guide sensors 22 and 82 sideways to or further than the lateral limit 56 of the blanket cylinders of the printing units. The guide sensors 21 and 81 are also moved past the lateral limit 55 of the blanket cylinders. Therefore, the entry guide 20 and exit guide 80 are essentially disabled, and the web is free to move between lateral limits of the blanket cylinder. However, with the controller, it is also possible to have the entry and exit guide sensors timed to follow the lateral movement of the web roll stand 10 as the web 1 is moved sideways.

The components of the folder 90, which may include angle bars 91 and slitters 92, will also be moved by signals from the controller 120 in the same direction. Motors (not shown) are provided for this purpose.

The fans 95 also will open slightly to allow any signature misalignment to pass through.

This entire movement of the various components of the press is synchronized by the controller 120 to allow the press to continue running as the final blanket wash occurs.

When ink build-up on one side of the blankets is cleaned by the blanket wash and the action of the web 1, which is placed against the lateral limit 56 of the blankets as described above, the web is then moved against the other lateral limit 55 in the same manner, i.e. by moving the roll stand 10 and the angle bars 91 and slitter 92 against their other lateral limit corresponding to lateral limit 55 of the blankets. The other side of the blankets is thus cleaned of ink build-up, leaving the blankets clean. The controller can automatically decelerate and shut down the press when the second lateral limit is reached, or can re-center the web roll stand 10 before shutting down the press.

It is understood that while the present invention has been described with respect to the embodiment described above, other embodiments may fall within the scope of the invention. For example, the printing press need not be an offset press, but may be a gravure or direct printing web press.

What is claimed is:

1. A printing press having a running web comprising:

a web roll stand for holding an end of the web in a wound state;

at least one printing unit comprising a printing cylinder for printing images on the running web;

an entry web guide between the web roll stand and the printing unit for guiding the web as it enters the printing unit;

an exit web guide for guiding the web as it exits the printing unit; and a wash unit for cleaning the printing cylinder during a wash cycle;

at least one of the entry web guide and the exit web guide being laterally moveable so as to be able to guide the web laterally during the wash cycle.

2. The printing press as recited in claim 1 wherein both the entry web guide and the exit web guide are laterally moveable.

3. A printing press having a running web comprising:

a web roll stand for holding the web in a wound state;

at least one printing unit comprising a printing cylinder for printing images on the running web, the printing cylinder having lateral limits for the running web; an entry web guide between the web roll stand and the printing unit for guiding the web as it enters the printing unit;

an exit web guide for guiding the web as it exits the printing unit;

a wash unit for cleaning the printing cylinder during a wash cycle; and a folder;

the web roll stand laterally moveable so as to allow the web to move against the lateral limits of the printing cylinder during the wash cycle.

4. The printing press as recited in claim 3 wherein the folder is laterally moveable.

5. The printing press as recited in claim 3 wherein the entry web guide has web guide sensors which are laterally moveable.

6. The printing press as recited in claim 3 wherein the exit web guide has web guide sensors which are laterally moveable.

7. The printing press as recited in claim 3 further comprising a controller for laterally moving the web roll stand.

8. The printing press as recited in claim 7 wherein the controller moves the web roll stand and at least one of the entry web guide, exit web guide and folder so as to allow the running web to move against the lateral limits of the printing cylinder.

9. The printing press as recited in claim 7 wherein the controller monitors the speed of the web during the wash cycle.

* * * * *